US008272625B1

(12) United States Patent
Bassett et al.

(10) Patent No.: US 8,272,625 B1
(45) Date of Patent: Sep. 25, 2012

(54) RETAINING BRACKET FOR A FENCE GATE

(76) Inventors: Kathleen A. Bassett, Cleveland, OH (US); Helen Werb, Cleveland, OH (US)

( * ) Notice: Subject to any disclaimer, the term of this patent is extended or adjusted under 35 U.S.C. 154(b) by 0 days.

(21) Appl. No.: 13/110,108

(22) Filed: May 18, 2011

(51) Int. Cl.
*E04H 17/16* (2006.01)
*E05C 5/00* (2006.01)

(52) U.S. Cl. ..... 256/73; 292/67; 292/114; 49/394; 16/230

(58) Field of Classification Search ..... 292/67, 292/328, 114; 16/230; 49/394; 256/73
See application file for complete search history.

(56) References Cited

U.S. PATENT DOCUMENTS

| | | | | | |
|---|---|---|---|---|---|
| 77,953 | A | * | 5/1868 | Bickerstaff | 292/328 |
| 720,496 | A | * | 2/1903 | Simpson | 292/156 |
| 1,100,647 | A | * | 6/1914 | Baumann | 292/63 |
| 1,487,667 | A | * | 3/1924 | Omler | 292/114 |
| 1,553,188 | A | * | 9/1925 | Sauton | 292/318 |
| 1,628,502 | A | * | 5/1927 | Letzau | 292/175 |
| 2,422,841 | A | * | 6/1947 | McClain | 292/328 |
| 3,583,738 | A | * | 6/1971 | Uphoff et al. | 292/67 |
| 3,751,084 | A | * | 8/1973 | Lening | 292/114 |
| 3,767,167 | A | * | 10/1973 | Rasmussen | 256/26 |
| 4,286,810 | A | * | 9/1981 | Ehmen | 292/67 |
| 4,388,749 | A | | 6/1983 | Sassak | |
| 4,500,124 | A | * | 2/1985 | Swift | 292/318 |
| D295,719 | S | * | 5/1988 | DeLuca et al. | D8/331 |
| D295,720 | S | * | 5/1988 | DeLuca et al. | D8/331 |
| 5,064,231 | A | * | 11/1991 | Mangone, Jr. | 292/319 |
| 5,103,658 | A | * | 4/1992 | McQuade | 70/77 |
| 5,205,022 | A | | 4/1993 | Norton | |
| 5,274,881 | A | * | 1/1994 | DeRosa | 16/230 |
| D347,163 | S | | 5/1994 | Issard | |
| 5,556,143 | A | * | 9/1996 | Robinson | 292/302 |
| 5,957,239 | A | * | 9/1999 | Marshak | 182/150 |
| 7,438,512 | B2 | | 10/2008 | Jakuszeski et al. | |

* cited by examiner

*Primary Examiner* — Victor MacArthur
(74) *Attorney, Agent, or Firm* — Montgomery Patent & Design, LLC; Robert C. Montgomery; Joseph Yaksich

(57) ABSTRACT

A retaining bracket for a fence gate used to secure the gates in a closed position relative to the fence includes a pair of axial members and a center "U"-shaped neck portion. Each opposing axial member is comprised of a straight rod and is attached to the neck portion. In use, a user holds an existing gate in the closed position and inserts an end portion of each axial member downward into a top-facing aperture located in a fence post and an adjacently opposing gate posts, thereby retaining the gate in its closed position.

3 Claims, 6 Drawing Sheets

RETAINING BRACKET FOR A FENCE GATE

RELATED APPLICATIONS

The present invention was first described in a notarized Official Record of Invention on Jul. 6, 2010, that is on file at the offices of Montgomery Patent and Design, LLC, the entire disclosures of which are incorporated herein by reference.

FIELD OF THE INVENTION

The present invention relates generally to fence gate latches, and in particular, to a bracket for retaining a fence gate in a closed position.

BACKGROUND OF THE INVENTION

Fence gates are used to provide access in and out of enclosed areas. While small gates which allow personnel access are easy to install and use, larger gates such as those across driveways are somewhat more difficult to design and implement. Many times, such gates are provided in two (2) parts which swing back and forth to allow vehicles and other large objects to pass. It is necessary to secure these two part gates in the middle when they are closed.

Many fence designs use a retractable pin that drops into a small hole in the pavement below. This solution however is plagued with multiple problems. First, the hole often becomes plugged with debris making it impossible to use. Second, the pin drags along the pavement as the gate is opened and closed. Over time this forms an unsightly arc on the pavement. The gate release mechanism is located low on the gate and is somewhat difficult to access. This makes it difficult for the elderly or disabled to use. The gate mechanism may also become completely buried in even a minor amount of snow.

Other fence gate latches utilize a generally "U"-shaped member having a base which pivots about a supporting fence post such that the "U"-shaped portion engages the gate post in a lowered position and disengages the gate post in a raised position so the gate can be opened. Still other types of latching mechanisms utilize a latch bar and a corresponding spring loaded catch.

While these familiar gate latching mechanisms may achieve their purported objective each suffers from one (1) or more disadvantage or deficiency related to design or utilization.

SUMMARY OF THE INVENTION

The inventor has therefore recognized the aforementioned inherent problems and lack in the art and observed that there remains a need for a gate retaining device in which fence gates of any size, but particularly large swinging gates, can be secured in a manner which addresses the disadvantages as described above. In accordance with the invention, it is an object of the present disclosure to solve these problems.

The inventor recognized these problems and has addressed this need by developing a retaining bracket for a fence gate that provides a means of securing swinging gates in a manner which is quick, easy and effective. The inventor has thus realized the advantages and benefits of providing the retaining bracket for a fence gate of a fence system having a "U"-shaped member with a semi-circular neck and a pair of opposing axial members. A pair of stop collars are each disposed between the neck and each axial member. The pair of axial members is insertable into apertures disposed in an upper portion of a fence gate post and a directly adjacent fence fixed post to retain the fence gate in a closed position relative to the fence system.

In an embodiment of the retaining bracket, the pair of axial members includes a first axial member at least partially insertable into the aperture of the gate post or the fixed post and a second axial member at least partially insertable into the aperture of an opposing respective fixed post or gate post.

In another embodiment, pair of stop collars includes a first stop collar which is affixed around an upper distal end of the first axial member adjacent to a base of the neck which limits insertion of the first axial member within the post aperture. A second stop collar is affixed around an upper distal end of the second axial member adjacent to a base of the neck which limits insertion of the second axial member within the opposing post aperture.

In another embodiment, the second axial member also includes a third stop collar affixed around an intermediate portion, where the third stop collar and a lower end of the second axial member are retained below the aperture of the opposing respective fixed post or gate post such that the second axial member is not removable from the opposing respective fixed post or gate post.

In another embodiment, a fence system is provided with the retaining bracket included as an integral feature. The fence enclosure includes a plurality of fence fixed posts retained to a ground surface and defining an area to be enclosed and a fencing attached to the plurality of fixed posts. A fence gate is disposed between two of the plurality of fixed posts and includes a pair of fence gate posts and a gate fencing attached between the gate posts. The "U"-shaped member is provided having a semi-circular neck and a pair of opposing axial members and a pair of stop collars, each stop collar being disposed between the neck and the axial member. One (1) of the pair of gate posts is hingedly attached to one of the plurality of fixed posts such that an opposing gate post is adjacent to another one (1) of the plurality of fixed posts. The pair of axial members is insertable into apertures disposed in an upper portion of the opposing gate post and the directly adjacent fixed post to retain the fence gate in a closed position relative to the fence enclosure.

Furthermore, the described features and advantages of the disclosure may be combined in various manners and embodiments as one skilled in the relevant art will recognize. The disclosure can be practiced without one (1) or more of the features and advantages described in a particular embodiment.

Further advantages of the present disclosure will become apparent from a consideration of the drawings and ensuing description.

BRIEF DESCRIPTION OF THE DRAWINGS

The advantages and features of the present disclosure will become better understood with reference to the following more detailed description and claims taken in conjunction with the accompanying drawings, in which like elements are identified with like symbols, and in which:

DESCRIPTIVE KEY

Figure 1:
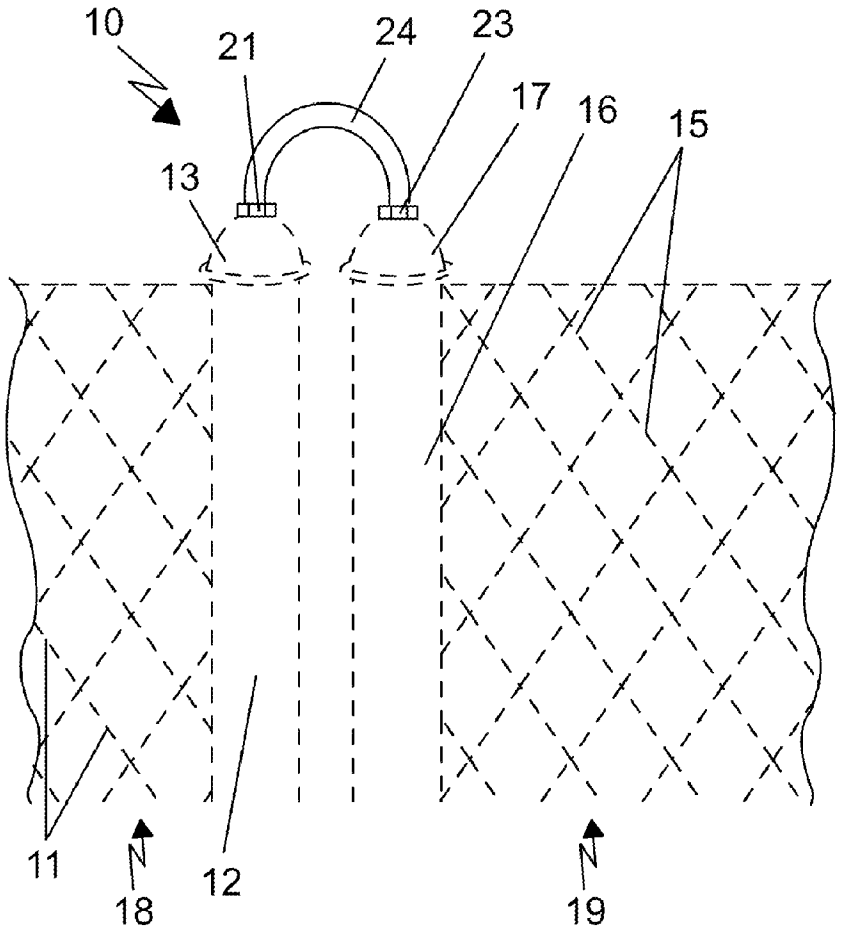
FIG. 1 is an environmental view of a retaining bracket for a gate depicted in a locked position, according to a preferred embodiment in accordance with the invention.

10 retaining bracket for a gate
11 fixed fencing
12 fixed post
13 fixed post upper portion
14 aperture
15 gate fencing
16 gate post
17 gate post upper portion
18 chain-link fence
19 gate
20 first axial member
21 first stop collar
22 second axial member
23 second stop collar
24 neck portion
25 welding
30 alternate retaining bracket
31 alternate first axial member
32 alternate first stop collar
33 alternate second axial member
34 upper stop collar
35 lower stop collar
36 alternate neck

DETAILED DESCRIPTION OF THE PREFERRED EMBODIMENT

In accordance with the invention, the best mode is presented in terms of a preferred embodiment, herein depicted within FIGS. 1 through 6. However, the disclosure is not limited to a single described embodiment and a person skilled in the art will appreciate that many other embodiments are possible without deviating from the basic concept of the disclosure and that any such work around will also fall under its scope. It is envisioned that other styles and configurations can be easily incorporated into the teachings of the present disclosure, and only one particular configuration may be shown and described for purposes of clarity and disclosure and not by way of limitation of scope.

The terms "a" and "an" herein do not denote a limitation of quantity, but rather denote the presence of at least one of the referenced items.

Referring now to FIGS. 1 through 6, depicting a retaining bracket for a gate (herein described as the "device") 10, where like reference numerals represent similar or like parts. In accordance with the invention, the present disclosure describes a retaining bracket which secures or locks a gate portion of a chain-link fence which in a closed state in a manner which is quick and easy and which eliminates cumbersome and challenging traditional locking techniques. The device 10 is preferably utilized with an existing chain-link-type fencing system having a hinged entry gate.

Figure 2:
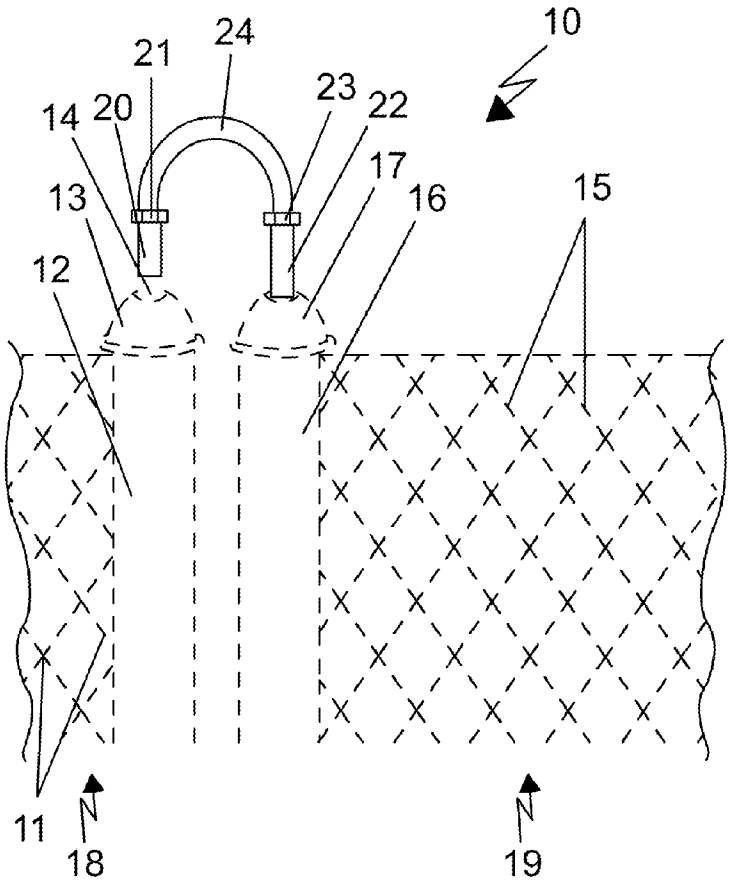
FIG. 2 is an environmental view of the retaining bracket for a gate depicted in an unlocked position, according to the preferred embodiment.

FIG. 1 and FIG. 2 show environmental view of the device 10 depicted in a locked position and in an unlocked position, respectively. Chain-link fences 18 typically include a plurality of fixed posts 12 located around a perimeter of the area which is fenced in. Only a single fixed post 12 which is directly adjacent to a gate 19 is illustrated here for clarity. The fixed posts 12 are used to stabilize the fixed fencing 11 and secure it to a ground surface, thereby enclosing the fenced-in area. Chain-link fences 18 also include a gate 19 which secures an ingress and egress opening in the fixed fencing 11. Typically the gate 19 is hingedly attached to a particular fixed post 12 and spans a distance between a nearby and adjacent fixed post 12. The gate 19 includes a pair of gate posts 16 and gate fencing 15 fastened between the gate posts 16. Only a single gate post 16 which is directly adjacent to an entry way fixed post 12 is illustrated here for clarity. Although the device 10 is illustrated as being utilized with a single gate fencing system, it can be appreciated that the device 10 can be utilized with various other gated systems such as chain-link fencing systems having a double gate without limiting the scope of said device 10.

An existing chain-link fence 18 is modified to receive and be used with the device 10 by drilling an aperture 14 into a top surface of an upper portion 13 of the fixed post 12 and a top surface of an upper portion 17 of the adjacent gate post 16. With the preexisting fencing system modified, the device 10 can then be installed and utilized.

Figure 3:
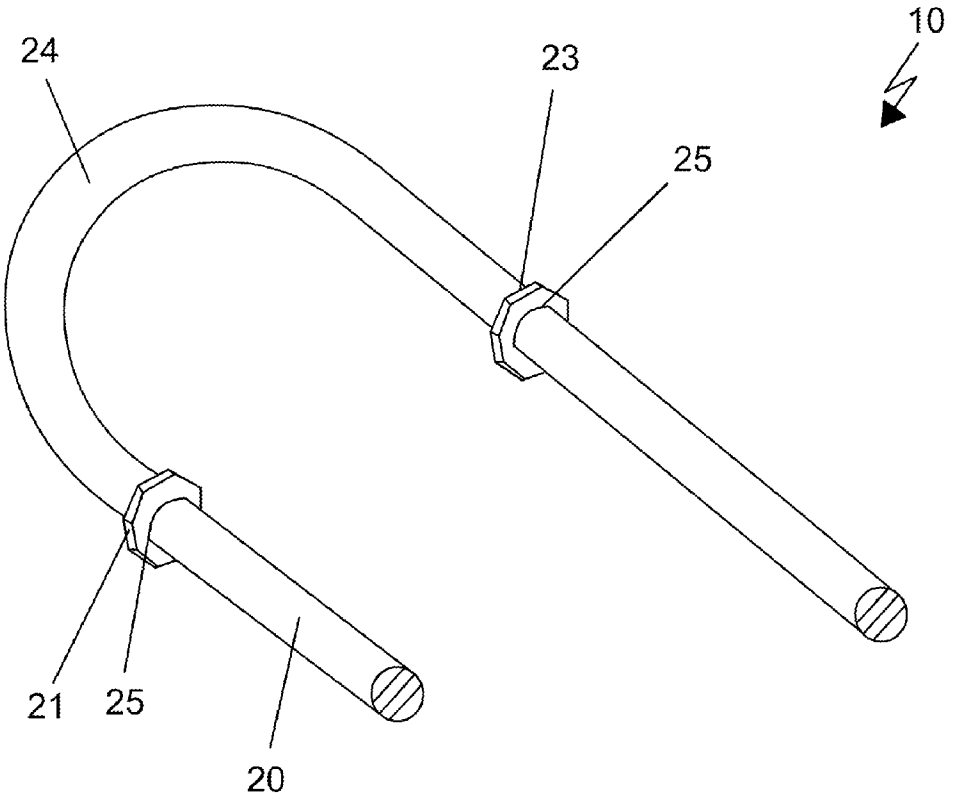
FIG. 3 is a perspective view of the retaining bracket for a gate, according to the preferred embodiment.

FIG. 3 shows a perspective view of the device 10. The device 10 generally includes a first axial member 20, a first stop collar 21, a second axial member 22, a second stop collar 23, and a neck portion 24. The device 10 forms a generally "U"-shape where the neck portion is curved such that the first axial member 20 and the second axial member are generally parallel. The device 10 is utilized in an inverted orientation and is removably attached between the top surface of a fixed post upper portion 13 and the top surface of a gate post upper portion 17.

The device 10 is preferably fabricated from materials such as, but not limited to: metal, plastic, or similar durable and rigid materials. The first axial member 20 is rod-shaped and is inserted into and removed from the aperture 14 in the fixed post upper portion 13. The first axial member 20 is downwardly inserted into the aperture 14 on the fixed post upper portion 13 to retain the gate 19 in the closed state and the first axial member 20 is lifted out from the aperture 14 to release the gate 19. The diameter of the first axial member 20 is smaller than the diameter of its respective aperture 14 to enable insertion within the aperture 14. The first stop collar 21 is affixed to a distal end portion of the first axial member 20 to predetermine a length of the first axial member 20 which is available to be inserted into the fixed post upper portion 13. The first stop collar 21 is preferably affixed to the fixed post upper portion 13 by welding 25. An outer diameter of the first stop collar 21 is larger than the diameter of the aperture 14 in the fixed post upper portion 13 to limit insertion of the first axial member 20 to the predetermined length. An upper proximal end portion of the first axial member 20 extends into the arcuate neck portion 24 which extends into the second axial member 22. The opposing first axial member 20 and second axial member 22 provide for the interconnection between the fixed post 12 and the gate post 16 to retain the gate 19 in the closed position. The distance between the axial members 20, 22 is approximately equivalent to the distance between apertures 14 in the fixed post 12 and the adjacent gate post 16, thus the device 10 is manufactured in various sizes to accommodate various fencing systems.

The device 10 attaches to the aperture 14 on the gate post upper portion 17 by inserting the second axial member 22 into the aperture 14. The second axial member 22 rod-shaped and is approximately double the length of the first axial member 21, which enables the second axial member 22 to remain within the aperture 14 in the gate post upper portion 17 while the first axial member 21 is moved between the locked and unlocked positions. The diameter of the second axial member 22 is smaller than the diameter of the aperture 14 to enable insertion within the aperture 14. The second stop collar 23 is affixed to a distal end portion of the second axial member 22 by welding 25 at a location approximately aligned with and parallel to the first stop collar 21. The second stop collar 23 restricts insertion of the second axial member 22 to a predetermined a length to be made available to be inserted into the gate post upper portion 17. An outer diameter of the second stop collar 23 is larger than the diameter of the aperture 14 in the gate post upper portion 17 to limit insertion of the second axial member 22 to the predetermined length.

Figure 4:
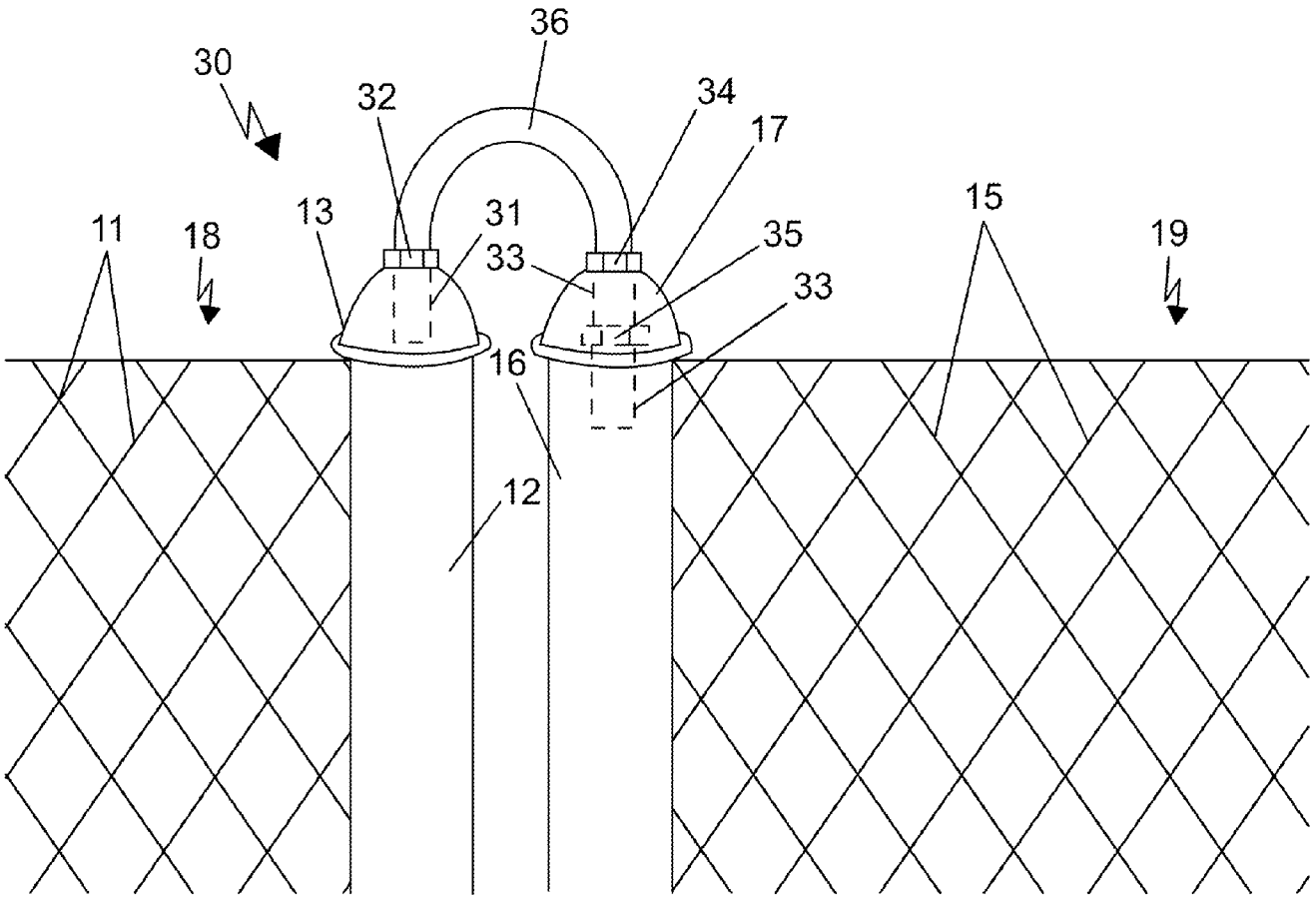
FIG. 4 is an environmental view of an alternate retaining bracket for a gate depicted in a locked position, according to an alternate embodiment in accordance with the invention.
Figure 5:
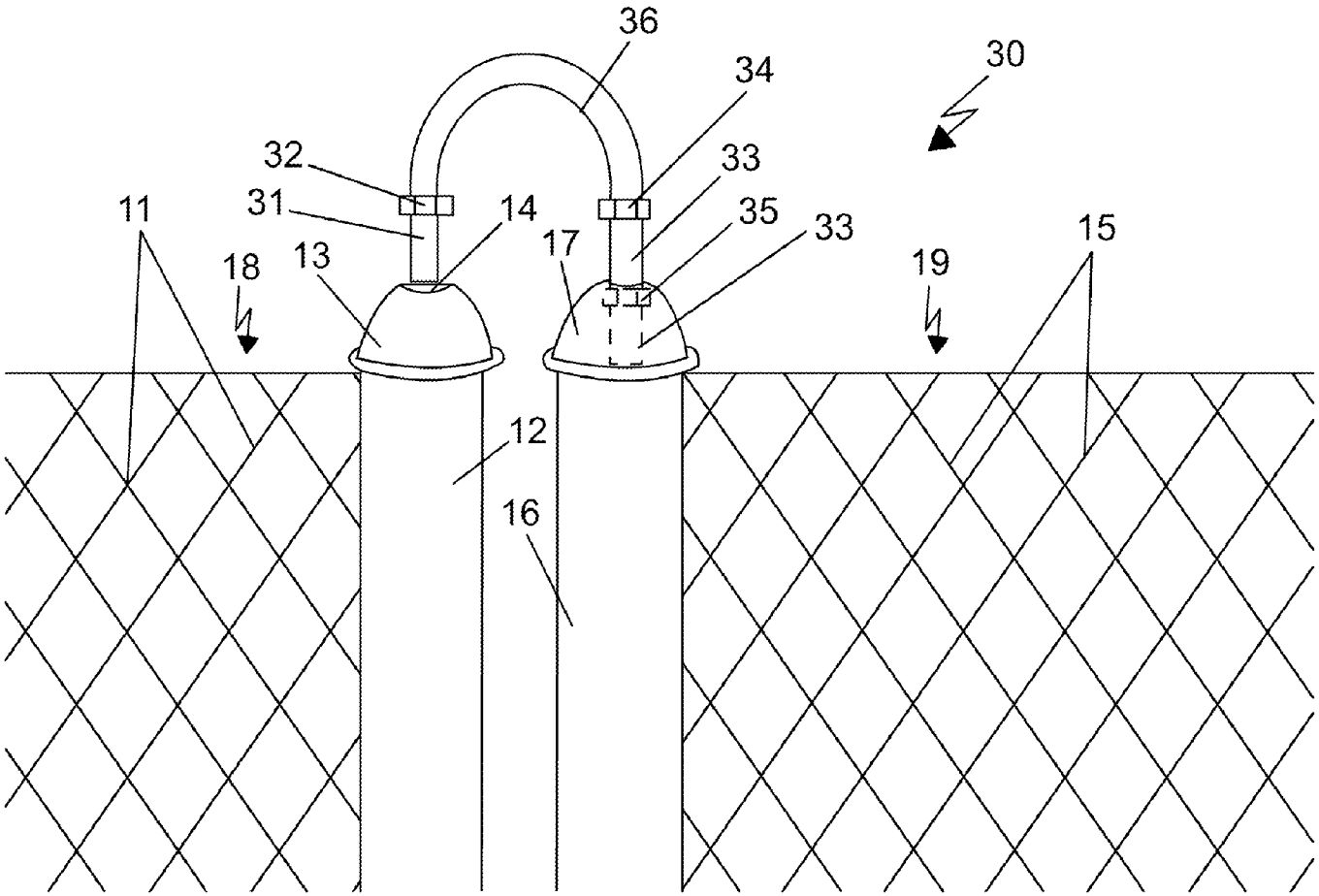
FIG. 5 is an environmental view of the alternate retaining bracket for a gate depicted in an unlocked position, according to an alternate embodiment; and, FIG. 6 is a perspective view of the alternate retaining bracket for a gate, according to an alternate embodiment.
Figure 6:
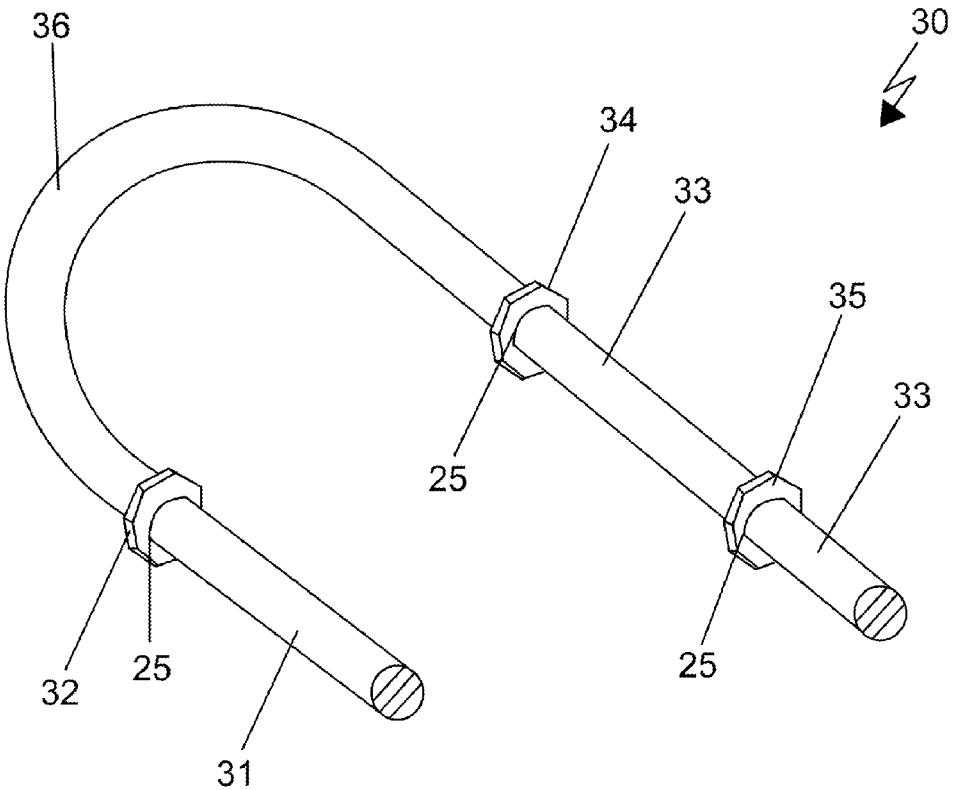

FIG. 4 and FIG. 5 show environmental views of an alternate retaining bracket for a gate 30 depicted in a locked position and in an unlocked position, respectively. FIG. 6 shows a perspective view of the alternate retaining bracket for a gate 30. The alternate retaining bracket for a gate 30 can be utilized to provide a quick and easy way of locking and unlocking a chain-link fencing system. The alternate retaining bracket for a gate 30 is an integral part of the chain-link fence 18 and gate 19 and is fabricated as a part the chain-link fencing system during the original manufacturing process.

The alternate retaining bracket for a gate 30 functions identically to the preferred embodiment 10, as abovementioned, and comprises an alternate first axial member 31, an alternate first stop collar 32, an alternate second axial member 33, an upper stop collar 34, a lower stop collar 35, and an alternate neck 35. The alternate first axial member 31, an alternate first stop collar 32, and alternate neck 35 are identical to the preferred embodiment of the device 10. The alternate second axial member 33 is permanently fastened into the gate post 16 by the upper stop collar 34 and lower stop collar 35. The diameters of the upper and lower stop collars 34, 35 are larger than the diameter of the aperture 14 on the gate post upper portion 17 to enable the alternate second axial member 33 to be fixed to the fixed post 12 or the gate post 16, the alternate retaining bracket for a gate 30 is illustrated here as fastened to the gate post 16. The upper stop collar 34 is affixed to an upper distal end portion of the alternate second axial member 33 and the lower stop collar 35 is attached to an intermediate portion of the alternate second axial member 33 by welding 25. The upper stop collar 34 is positioned externally to an upper surface of the gate post upper portion 17 and the lower stop collar 35 is positioned internally within the gate post upper portion 17, thereby enabling the alternate retaining bracket for a gate 30 to only be extended enough to remove the alternate first axial member 31 from its respective aperture 14 and prohibiting the alternate retaining bracket for a metal gate 30 from being completely removed from the gate 19. The alternate first axial member 31 is inserted into the aperture 14 of an adjacent fixed post upper portion 13.

It is envisioned that other styles and configurations can be easily incorporated into the teachings of the present disclosure and only one particular configuration has been shown and described for purposes of clarity and disclosure and not by way of limitation of scope.

In accordance with the invention, the preferred embodiment can be utilized by the user in a simple and effortless manner with little or no training. After initial purchase or acquisition of the device 10, it would be installed as indicated in FIGS. 1 and 2 and alternately as indicated in FIGS. 4 and 5.

The method of utilizing the device 10 can be achieved by performing the following steps: acquiring the device 10; drilling apertures 14 into the fixed post upper portion 13 and gate post upper portion 17; inserting the second axial member 22 into the aperture 14 on the gate post upper portion 17; locking the gate 19 to the chain-link fence 18 by inserting the first axial member 20 into the aperture 14 on the fixed post upper portion 13 adjacent to the gate 19; removing the first axial member 20 from the aperture 14 to unlock the gate 19 from the chain-link fence 18 as desired; and, providing a means of securing gates in a manner which is quick, easy and effective.

The method of utilizing the alternate retaining bracket for a metal gate 30 can be achieved by performing the following steps: acquiring the alternate retaining bracket for a gate 30; installing the gating system as would be instructed or installed professionally; locking the gate 19 to the chain-link fence 18 by inserting the alternate first axial member 31 into the aperture 14 on the fixed post upper portion 13 adjacent to the gate 19; removing the alternate first axial member 31 from the aperture 14 to unlock the gate 19 from the chain-link fence 18 as desired; enabling the alternate second axial member 33 is remain in a fixed position via the upper and lower stop collars 34, 35; and, providing a means of securing gates in a manner which is quick, easy and effective.

The foregoing descriptions of specific embodiments have been presented for purposes of illustration and description. They are not intended to be exhaustive or to limit to the precise forms disclosed and many modifications and variations are possible in light of the above teachings. The embodiments were chosen and described in order to best explain principles and practical application to enable others skilled in the art to best utilize the various embodiments with various modifications as are suited to the particular use contemplated.

What is claimed is:

1. A fence system with a retaining bracket comprising:

a fence enclosure comprising a plurality of fence fixed posts retained to a ground surface and defining an area to be enclosed and a fencing attached to said plurality of fixed posts;

a fence gate disposed between two of said plurality of fixed posts further comprising a pair of fence gate posts and a gate fencing attached between said gate posts, one of said pair of gate posts being hingedly attached to one of said plurality of fixed posts such that an opposing free gate post is adjacent to another one of said plurality of fixed posts;

a gate post aperture disposed in an upper end of said free gate post adjacent to said fixed post;

a fixed post aperture disposed in an upper end of said fixed post adjacent to said free gate post;

a "U"-shaped member comprising:

first axial member insertable within said gate post aperture having an upper end and a lower end; and, an elongated second axial member parallel to said first axial member and movable within said fixed post aperture having an upper end rigidly joined to said first axial member upper end by a semi-circular neck and a lower end extending past said first axial member lower end;

a first stop collar affixed around said first axial member upper end adjacent to said neck to limit insertion of said first axial member into said gate post aperture;

a second stop collar affixed around said second axial member upper end adjacent to said neck to limit downward movement of said second axial member within said fixed post aperture when said first axial member lower end is inserted into said gate post aperture to secure said gate post to said fixed post; and, a third stop collar affixed around said second axial member between said upper end and said lower end to limit upward movement of said second axial member within said fixed post aperture when said first axial member lower end is removed from said gate post aperture to release said gate post from said fixed post.

2. The bracket of claim 1, wherein said second axial member is longer than said first axial member.

3. The bracket of claim 2, wherein said "U"-shaped member is rigid.

* * * * *